US011664138B2

(12) United States Patent
Huang et al.

(10) Patent No.: US 11,664,138 B2
(45) Date of Patent: May 30, 2023

(54) COMPOSITE CABLE INCLUDING COLLECTIVE BRAIDED SHIELD

(71) Applicant: Hitachi Metals, Ltd., Tokyo (JP)

(72) Inventors: Detian Huang, Tokyo (JP); Takanobu Watanabe, Tokyo (JP); Takanori Komuro, Tokyo (JP)

(73) Assignee: PROTERIAL, LTD., Tokyo (JP)

( * ) Notice: Subject to any disclaimer, the term of this patent is extended or adjusted under 35 U.S.C. 154(b) by 0 days.

(21) Appl. No.: 17/522,856

(22) Filed: Nov. 9, 2021

(65) Prior Publication Data

US 2022/0157494 A1 May 19, 2022

(30) Foreign Application Priority Data

Nov. 13, 2020 (JP) ..... JP2020-189320

(51) Int. Cl.

| | |
|---|---|
| ***H01B 11/10*** | (2006.01) |
| ***H01B 11/18*** | (2006.01) |
| ***H01B 7/22*** | (2006.01) |
| ***H01B 7/00*** | (2006.01) |

(52) U.S. Cl.

CPC ..... *H01B 11/1025* (2013.01); *H01B 7/0045* (2013.01); *H01B 7/225* (2013.01); *H01B 11/1834* (2013.01)

(58) Field of Classification Search

CPC .... H01B 11/1033; H01B 9/024; H01B 9/003; H01B 7/17; H01B 11/06; H01B 7/1875; H01B 11/1025; H01B 11/1834; H01B 7/0045; H01B 7/225

USPC ..... 174/113 R

See application file for complete search history.

(56) References Cited

U.S. PATENT DOCUMENTS

2016/0020002 A1* 1/2016 Feng ..... H01B 11/20 174/103
2018/0286538 A1* 10/2018 Hayakawa ..... H01B 7/1875
2019/0210543 A1* 7/2019 Hayakawa ..... H01B 3/30

FOREIGN PATENT DOCUMENTS

JP 2011-090866 A 5/2011

* cited by examiner

*Primary Examiner* — Timothy J Thompson
*Assistant Examiner* — Michael F McAllister
(74) *Attorney, Agent, or Firm* — McGinn I.P., Law Group, PLLC.

(57) ABSTRACT

A composite cable includes a signal transmission cable including a pair of signal lines being arranged parallel to each other in a cable longitudinal direction and contacting to each other and a shield layer covering the pair of signal lines together, a pair of power supply lines being arranged contacting to each other and contacting to the shield layer, a collective braided shield covering around a cable core composed of the signal transmission cable and the pair of power supply lines collectively, a sheath covering around the collective braided shield. The collective braided shield is configured closely contacting to the shield layer in accordance with an outer shape of the shield layer.

6 Claims, 2 Drawing Sheets

COMPOSITE CABLE INCLUDING COLLECTIVE BRAIDED SHIELD

CROSS-REFERENCE TO RELATED APPLICATION

The present patent application claims the priority of Japanese patent application No. 2020-189320 filed on Nov. 13, 2020, and the entire contents of Japanese patent application No. 2020-189320 are hereby incorporated by reference.

TECHNICAL FIELD

The present invention relates to a composite cable.

BACKGROUND ART

Composite cables combining power supply lines and signal lines are widely used as conventional cables (see e.g., the patent literature 1).

CITATION LIST

Patent Literatures

Patent Literature 1: JP 2011-90866A

SUMMARY OF INVENTION

In recent years, the development of automated driving technologies has made significant progress in automotive industry or the like. The image quality of cameras used for automated driving has been greatly improved, so the composite cables for such cameras need very high signal transmission speed that allows transmission of a large capacity of image data. Additionally, the composite cables for cameras used for vehicles may be wired over for several meters, therefore, high frequency characteristics that allow transmission of high-speed signals for a long distance are required. To secure safety of automated driving, the composite cables that allow stable high-speed transmission are required.

However, the high frequency characteristics of conventional composite cables are easily deteriorated, especially when composite cables are bent, twisted or the like. Thus, further improvement of high frequency characteristics has been required.

For the above reason, the object of the present invention is to provide a composite cable with improved high frequency characteristics.

For solving the above problems, one aspect of the present invention provides a composite cable comprising:

- a signal transmission cable including a pair of signal lines being arranged parallel to each other in a cable longitudinal direction and contacting to each other and a shield layer covering the pair of signal lines together;
- a pair of power supply lines being arranged contacting to each other and contacting to the shield layer;
- a collective braided shield covering around a cable core comprising the signal transmission cable and the pair of power supply lines collectively; and
- a sheath covering around the collective braided shield,
- wherein the collective braided shield is configured closely contacting to the shield layer in accordance with an outer shape of the shield layer.

Effect of Invention

According to the present invention, it is possible to provide a composite cable with improved high frequency characteristics.

DESCRIPTION OF EMBODIMENTS

Embodiment

The embodiment of the present invention will be explained below in conjunction with appended drawings.

Figure 1:
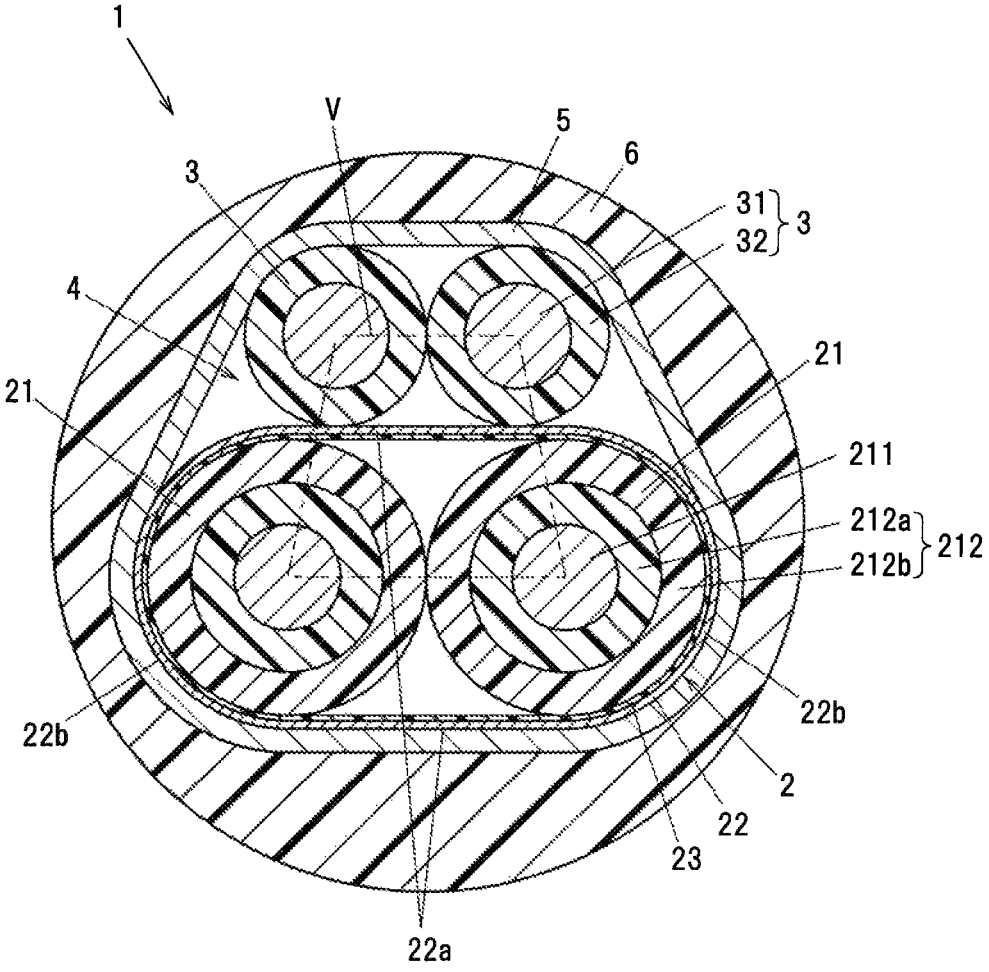
FIG. 1 is a cross-sectional view showing a cross-section perpendicular to a longitudinal direction of a composite cable in an embodiment of the present invention.

FIG. 1 is a cross-sectional view showing a cross-section perpendicular to a longitudinal direction of a composite cable in the present embodiment. The composite cable 1 in FIG. 1 is used, e.g., to connect cameras (e.g., cameras for automated driving) that are installed in vehicles.

As shown in FIG. 1, the composite cable 1 is composed of a signal transmission cable 2 including a pair of signal lines (signal wires) 21, a shield layer 22 that covers the pair of signal lines 21 collectively, a pair of power supply lines (power supply wires) 3, a collective braided shield 5 that covers a cable core 4 in which the signal transmission cable 2 and the pair of power supply lines 3 are stranded, and a sheath 6 that covers the collective braided shield 5.

(Power Supply Line 3)

The pair of power supply lines 3 are used to supply electric power to a camera, etc. Each of the pair of power supply lines 3 is respectively composed of a conductor 31 and an insulator 32 that covers the conductor 31. The conductor 31 is a strand wire conductor made of multiple metal wires stranded together. As metal wires used for the conductor 31, annealed copper wires and copper alloy wires can be used as well as plated wires. In the present embodiment, the conductor 31 is produced by concentrically stranding seven metal wires made of tin-plated annealed copper wires with an outer diameter of 0.16 mm. As the insulator 32, e.g., an insulator made of polyvinyl chloride resin composition can be used. The outer diameter of the conductor 31 is, e.g., 0.40 mm or more and 0.50 mm or less. The two power supply lines 3 should be arranged parallel to each other in a cable longitudinal direction.

(Signal Transmission Cable 2)

The signal transmission cable 2 is used to transmit image signals from the camera. The signal transmission cable 2 is composed of the pair of signal lines 21 that are arranged parallel to each other in the cable longitudinal direction and contacting to each other, and the shield layer 22 that collectively covers the pair of signal lines 21.

Each of the pair of signal lines 21 is composed of a signal conductor 211 and an insulator 212 that covers around the signal conductor 211. The signal conductor 211 is a strand wire conductor made of multiple metal wires stranded together. As metal wires used for the signal conductor 211, annealed copper wires and copper alloy wires can be used as well as plated wires such as tin-plated or silver-plated wires. In the present embodiment, the signal lines 21 are configured by using metal wires made of silver-plated annealed copper wires with high conductivity. Also, the signal conductor 211 can be a compressed strand wire conductor that has been lightly compressed in such a manner that the strand wire conductor has a circular cross-section. By configuring the signal conductor 211 with a compressed strand wire conductor, the resistance of the signal conductor 211 is largely suppressed by reducing a gap between the metal wires, and at the same time, the signal conductor 211 with high flex resistance can be realized. It is preferable that the conductor cross-sectional area of the signal conductor 211 is equal to or greater than the conductor cross-sectional area of the conductor 31 of the power supply line 3. This facilitates high speed transmission of signals such as image signals from cameras. Also, the conductor cross-sectional area of the conductor 31 is, e.g., 0.12 $mm^2$ or more and 0.20 $mm^2$ or less.

As the insulator 212, it is preferable to use an insulator with least electric permittivity to maintain high frequency characteristics in good conditions. Also, it is preferable to adjust a thickness of the insulator 212 to make the characteristic impedance of the signal lines 21 a desired value. In the present embodiment, the thickness of the insulator 212 was adjusted to set the characteristic impedance of the signal lines 21 to 50Ω (characteristic impedance of the entire signal transmission cable 2 to 100Ω). Additionally, it is preferable to make the characteristic impedance of the signal transmission cable 2 in 100±5Ω. The measurement of characteristic impedance can be, e.g., figured out by TDR (Time Domain Reflectometry) method. If the thickness of the insulator 212 is adjusted here in order to set the characteristic impedance of the signal lines 21 to 50Ω, the insulator 212 becomes thicker and the outer diameter of the signal lines 21 becomes greater, and therefore, the connection to the existing connectors could be difficult. For that reason, in the present embodiment, the insulator 212 is configured with an inner insulator 212*a* that covers around the signal conductor 211 and an outer insulator 212*b* that covers around the inner insulator 212*a*.

Figure 2:
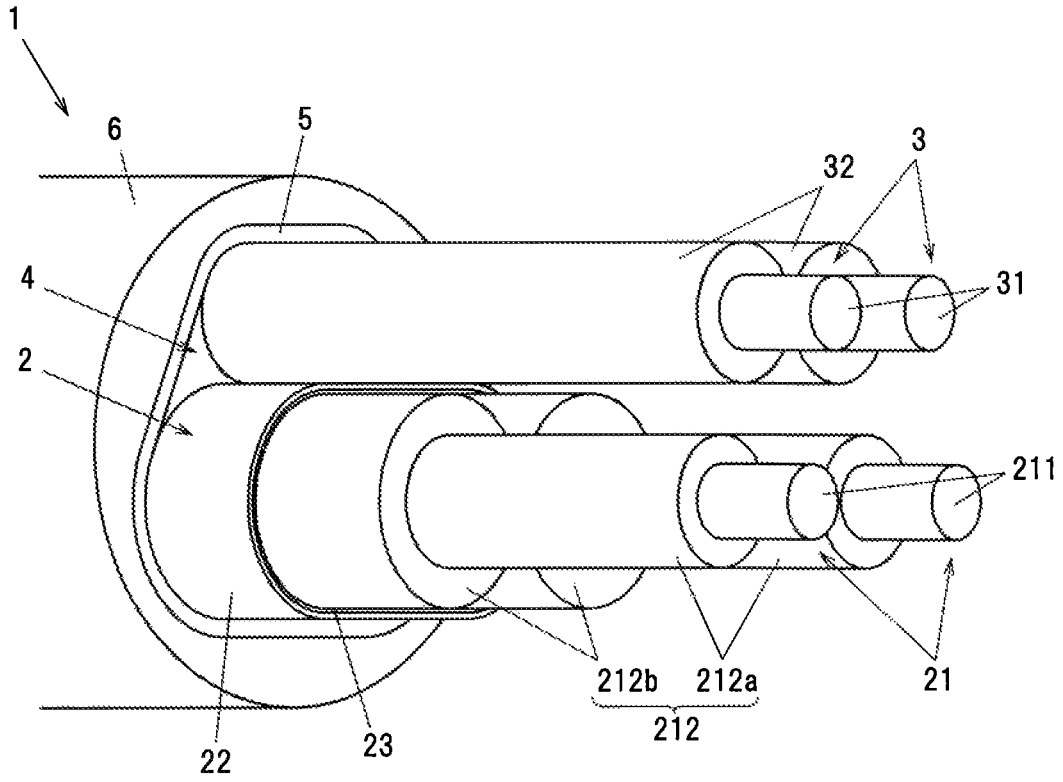
FIG. 2 is a perspective view for explaining terminal treatment of the composite cable in FIG. 1.

Therefore, as shown in FIG. 2, the outer diameter of the signal lines 21 is reduced at a cable terminal by stripping and removing the outer insulator 212*b* from the inner insulator 212*a* in the terminal processing. This enables an exposed part of the inner insulator 212*a* to be connected to a connector, and thus, facilitates the connection to an existing connector with high versatility. In other words, it enables the following two things at the same time: increasing the characteristic impedance by increasing the thickness of the insulator 212 in the signal lines 21 (by increasing the outer diameter of the signal lines 21) to transmit signals from cameras in high speed, and connecting the cable terminal to a connector without changing a connector structure according to an increased diameter of the signal lines 21 (for example, without changing the position of a connector pin for connecting the signal conductor 211 according to an increased diameter of the signal lines 21). It is preferable that the outer diameter of the inner insulator 212*a* is equal to or greater than the outer diameter of the power supply line 3. For example, it is preferable that the outer diameter of the inner insulator 212*a* is in the range of 1 to 1.5 times of the outer diameter of the power supply line 3.

It is preferable that the inner insulator 212*a* is made by full extrusion or tube extrusion. Especially, the inner insulator 212*a* can be easily stripped and removed from the signal conductor 211 by making the inner insulator 212*a* by tube extrusion, and thus, workability is improved in the terminal processing to connect the cable terminal to a connector, etc. Additionally, by making the inner insulator 212*a* by tube extrusion, the signal conductor 211 can be easily moved inside the inner insulator 212*a* when the composite cable 1 is bent or twisted, thus, the resistance to bending and twisting is improved.

It is preferable to make the outer insulator 212*b* by tube extrusion. By doing this, an inner surface of the outer insulator 212*b* does not easily adhere to an outer surface of the inner insulator 212*a*, so that the outer insulator 212*b* can be easily stripped and removed from the outer surface of the inner insulator 212*a* when processing the terminal to connect the cable terminal to a connector, etc. Therefore, the workability in the terminal processing is improved.

In making the outer insulator 212*b* (at extrusion molding), to avoid the outer insulator 212*b* from being welded to the inner insulator 212*a*, it is preferable to use a resin with a lower melting point for the outer insulator 212*b* than that of the resin used for the inner insulator 212*a*. The melting point of the resin used for the inner insulator 212*a* is, e.g., 250° C. or more and 330° C. or less. The melting point of the resin used for the outer insulator 212*b* is, e.g., 90° C. or more and 170° C. or less. Also, to maintain the high frequency characteristics, it is preferable that the inner insulator 212*a*, which is closer to the signal conductor 211, has lower permittivity than that of the outer insulator 212*b*. The permittivity of the inner insulator 212*a* is, e.g., from 2.0 or more and 2.8 or less (more preferably, 2.1 or more and 2.6 or less). Also, to maintain the high frequency characteristics, it is preferable that the thickness of the inner insulator 212*a* is thicker than that of the outer insulator 212*b*. The thickness of the inner insulator 212*a* is, e.g., from 1.5 to 2.0 times of the thickness of the outer insulator 212*b* (more preferably in the range from 1.6 to 1.7 times). In the present embodiment, as the inner insulator 212*a*, fluorine resins with low permittivity such as FEP (tetrafluoroethylene hexafluoropropylene copolymer) or PFA (tetrafluoroethylene perfluoroalkyl vinyl ether copolymer) are used. Also, as the outer insulator 212*b*, resins such as PE (polyethylene) and PP (polypropylene) are used, because they have relatively low permittivity and are not easily welded to the inner insulator 212*a* which is made of fluorine resin.

Additionally, it is preferable that both the inner insulator 212*a* and the outer insulator 212*b* have elongation of 150% or above. With the above elongation, even if two signal lines 21 are arranged parallel to each other in the cable longitudinal direction and contacting to each other so that the two signal lines 21 are not easily moved when twisted, the inner insulator 212*a* and the outer insulator 212*b* are not easily broken by bending or twisting. Therefore, the signal transmission cable 2 is able to perform stable signal transmission, even if it is bent or twisted in wiring.

As described above, to set the characteristic impedance of the signal lines 21 to a desired value, the outer diameter of the signal line 21 is relatively large in the present embodiment. Thus, the power supply line 3 has a smaller outer diameter than that of the signal lines 21. To be more specific, the outer diameter of the power supply line 3 is at least 0.5 times but less than 1 time of the outer diameter of the signal lines 21. In the present embodiment, the outer diameter of the signal lines 21 is 1.50 mm or more and 1.80 mm or less, and the outer diameter of the power supply line 3 is at least 1.00 mm but less than 1.50 mm.

The pair of signal lines 21 are arranged parallel to each other and contacting to each other. In other words, the signal transmission cable 2 is a two-core parallel cable. Also, a resin tape made of PET (polyethylene terephthalate) and the like is spirally wrapped around the pair of signal lines 21.

The shield layer 22 is configured by spirally wrapping a metal tape around the resin tape 23.

Figure 3:
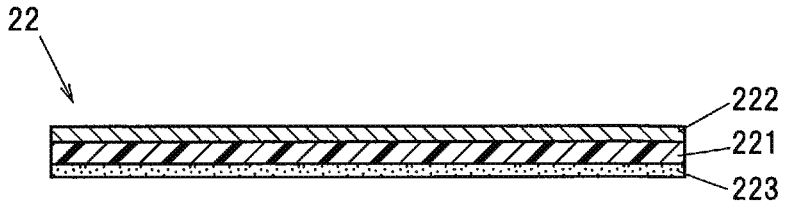
FIG. 3 is a cross-sectional view of a metal tape that is used for a shield layer.

As shown in FIG. 3, the metal tape that configures the shield layer 22 has a metal layer 222 on one side of a resin layer 221 and an adhesive layer 223 on the other side of the resin layer 221. In the present embodiment, a metal tape composed of an Al/PET tape wherein the metal layer 222 made of Al (aluminum) is provided on one side of the resin layer 221 made of PET (polyethylene terephthalate), and the adhesive layer 223 made of thermosetting resin is provided on the other side of the resin layer 221, is used. However, the present invention is not limited thereto, and a metal tape with the metal layer 222 made of copper can be used. Also, a metal tape with the resin layer 221 made of polyester resin other than PET can be used.

The shield layer 22 is configured by spirally wrapping a metal tape around the resin tape 23 in such a manner that the adhesive layer 223 is at the side of the resin tape 23 (so that the metal layer 222 is at the side of the collective braided shield 5). By applying heat after wrapping a metal tape around the resin tape 23, a thermosetting resin that configures the adhesive layer 223 adheres the metal tape to the metal tape as well as the metal tape to the resin tape 23. With this configuration, the pair of signal lines 21 can be maintained more securely. Also, it suppresses the shield layer 22 from separating from the signal lines 21, so it can control the position change of the signal lines 21 due to the separation from the shield layer 22, and the deterioration of high frequency characteristics by restraining the distance change between the signal lines 21 and the shield layer 22 when they are bent or twisted. Additionally, because the shield layer 22 does not adhere to the signal lines 21 directly in this configuration, the shield layer 22 can be removed from the signal lines 21 easily when processing the terminal. Thus, the workability in the terminal processing is improved.

It is preferable that a wrapping direction of the metal tape that configures the shield layer 22 is different from a wrapping direction of the resin tape 23 which is a base of the metal tape. By doing this, the metal tape that configures the shield layer 22 and the resin tape 23 can adhere to each other firmly and the position of the two signal lines 21 arranged in parallel to each other cannot be easily changed when they are bent or twisted. Also, the signal lines 21 are not easily twisted over each other, so the distance between the signal lines 21 can be stabilized, and thus the characteristic impedance can be stabilized in the cable longitudinal directions. Additionally, the wrapping direction of the metal tape or the resin tape 23 is the direction where the metal tape or the resin tape 23 is rotating from one end to the other end when being viewed from the one end of the signal transmission cable 2.

The shield layer 22 is configured in a substantially ellipse shape (rounded rectangle) in the cross-sectional view perpendicular to the cable longitudinal direction, and has a pair of flat areas 22*a* extending straight along an arrangement direction of the pair of signal lines 21, and a pair of round areas 22*b* connecting the ends of the pair of flat areas 22*a* in one piece.

(Cable Core 4)

The cable core 4 is composed of the signal transmission cable 2 and a pair of power supply lines 3 stranded collectively (rigid strand). In other words, the signal transmission cable 2 and the power supply lines 3 are stranded with the same pitch. It is preferable that the stranding direction of the cable core 4 is the same as the wrapping direction of the metal tape that configures the shield layer 22. This prevents the metal tape that configures the shield layer 22 from being opened (unwrapped) by stranding of the cable core 4, so high frequency characteristics can be stabilized. Additionally, the stranding direction of the cable core 4 is the direction where the signal transmission cable 2 and the power supply lines 3 are rotating from one direction to the other, seeing from one end of the cable core 4.

The pair of power supply lines 3 are arranged parallel to each other, and contacting to each other, and at the same time, they are arranged respectively contacting to the outer surface of the shield layer 22 of the signal transmission cable 2. In other words, one power supply line 3, the other power supply line 3, and the signal transmission cable 2 are arranged sequentially in a cable circumferential direction, and the two power supply lines 3 and the signal transmission cable 2 are contacting to each other. The pair of power supply lines 3 are arranged respectively contacting to one of the flat areas 22*a* of the shield layer 22. Additionally, the two power supply lines 3 can be stranded, but considering the downsizing of the composite cable 1 in diameter, and fixing the position of the signal transmission cable 2 (make it difficult to move) inside the cable core 4, it is preferable that the two power supply lines 3 are arranged parallel to each other in the cable longitudinal direction. Also, the two power supply lines 3 are arranged so that the insulator 32 is contacting to the collective braided shield 5.

Also, the arrangement direction of the pair of power supply lines 3 is almost equal to that of the pair of signal lines 21, centers of the pair of power supply lines 3 (the position where the power supply lines 3 are contacting to each other) and centers of the pair of signal lines 21 (the position where the signal lines 21 are contacting to each other) are aligned perpendicular to the arrangement direction of the power supply lines 3 and the signal lines 21. Therefore, the cable core 4 is configured in such a manner that a virtual line V connecting the centers of the pair of signal lines 21 and the centers of the pair of power supply lines 3 makes a trapezoid in the cross-sectional view perpendicular to the cable longitudinal directions.

(Collective Braided Shield 5)

The collective braided shield 5 covers around the cable core 4 entirely. The collective braided shield 5 is configured by braiding metal wires. As metal wire used for the collective braided shield 5, annealed copper wire, copper alloy wire, aluminum wire, aluminum alloy wire, and the like can be used. Also, as metal wire used for the collective braided shield 5, copper foil yarn which is a thread spirally wrapped by copper foil, can be used as well.

In the composite cable 1 according to the present embodiment, the collective braided shield 5 is configured closely contacting to the shield layer 22 in accordance with the outer shape of the shield layer 22 of the signal transmission cable 2. Strictly speaking, an inner surface of the collective braided shield 5 is closely contacting over an entire outer surface (surface of the metal layer 222) of the flat area 22*a* on the side where the pair of power supply lines 3 are not contacting to, and over a part of the outer surface of the pair of round areas 22*b* (surface of the metal layer 222) at the both sides of the flat area 22*a* of the shield layer 22. It is preferable that the collective braided shield 5 is closely contacting to at least more than half of the outer surface of the round areas 22*b*. Additionally, "closely contacting" here means not only a case where two surfaces are contacting without a gap, but also a case where a little gap exists between them in the scope where the effects of the present invention described below are satisfied. In other words, a little gap between the shield layer 22 and the collective braided shield 5 is allowed as long as the effects of the present invention are not interfered.

Also, the composite cable 1 does not have a drain wire between the shield layer 22 and the collective braided shield 5. If there is a drain wire between the shield layer 22 and collective braided shield 5, a gap is made between the shield layer 22 and the collective braided shield 5. As a result, high frequency characteristics may become unstable, because an electric potential difference is caused between the shield layer 22 and the collective braided shield 5, or because the gap size is changed when the cable is bent or twisted. By configuring the collective braided shield 5 contacting to the outer shape of the shield layer 22 as the present embodiment, high frequency characteristics can be stably maintained even when the cable is bent or twisted.

Also, the collective braided shield 5 covers the entire cable core 4, while contacting the outer surface of the pair of power supply lines 3 (an outer surface of the insulator 32). The collective braided shield 5 is configured in a substantially trapezoid shape (round trapezoid) in the cross-sectional view perpendicular to the cable longitudinal direction. By configuring the collective braided shield 5 in a substantially trapezoid shape as the present embodiment, the worker can easily see where the signal transmission cable 2 and the power supply lines 3 are arranged inside the composite cable 1. Therefore, the workability in the terminal processing can be improved.

(Sheath 6)

The sheath 6 covers around the collective braided shield 5. The sheath 6 not only protects the cable core 4 and the collective braided shield 5 but also presses inward the collective braided shield 5 so that it is closely contacting to the shield layer 22.

The sheath 6 covers around the collective braided shield 5, and its inner surface is configured along an outer shape of the collective braided shield 5 in substantially trapezoid shape in the cross-sectional view perpendicular to the cable longitudinal direction. Also, an outer surface of the sheath 6 is configured in a substantially circle shape in the cross-sectional view perpendicular to the cable longitudinal direction. In other words, the outer shape of the sheath 6 (an outer shape of the composite cable 1) is in a substantially circle shape in the cross-sectional view perpendicular to the cable longitudinal direction. It is preferable to make the sheath 6 by insert extrusion. By making the sheath 6 by insert extrusion, the outer shape of the sheath 6 can be a circle with very little gap between the sheath 6 and the collective braided shield 5. The thickness of the sheath 6 is non-uniform along the cable circumferential direction. In concrete terms, the thickness of the sheath 6 is large in a part where the sheath 6 is covering the sides (straight sides in FIG. 1) of the collective braided shield 5 of substantially trapezoid shape in the cross-sectional view perpendicular to the cable longitudinal direction, while the thickness of the sheath 6 is small in a part where the sheath 6 is covering the corners of the collective braided shield 5 (four round corners in FIG. 1).

By configuring the sheath 6 in this structure, the sheath 6 tightens the collective braided shield 5 toward the cable core 4, and thus, a gap cannot be generated between the collective braided shield 5 and the shield layer 22 (the collective braided shield 5 and the shield layer 22 are always closely contacting), even when the composite cable 1 is bent or twisted. As a result, the composite cable 1 can maintain the high frequency characteristics with very little deterioration, even if it is bend or twisted when wiring. Also, with a substantially circle shape as in the present embodiment, the composite cable 1 easy to wire even in a narrow space can be realized. Additionally, the cross-section (cross-sectional view perpendicular to the cable longitudinal direction) of the sheath 6 configured by tube extrusion can be in a substantially cylindrical shape, as long as the effects of the present invention are not interfered.

(Function and Effects of the Embodiment)

As explained above, the composite cable 1 in the present embodiment is composed of the pair of signal lines 21 that are arranged parallel to each other in the cable longitudinal direction and contacting to each other, the signal transmission cable 2 having the shield layer 22 that covers the pair of signal lines 21 collectively, and the pair of power supply lines 3 that are arranged contacting to each other and contacting to the shield layer 22 respectively, and the collective braided shield 5 that collectively covers around the cable core 4 having the signal transmission cable 2 and the pair of power supply lines 3, the sheath 6 that covers the collective braided shield 5. The collective braided shield 5 is configured closely contacting to the outer shape of the shield layer 22.

Closely contacting the collective braided shield 5 and the shield layer 22, for example, improves a fault that a gap between the collective braided shield 5 and the shield layer 22 is changed when the cable is bent or twisted, as in the case where a drain wire is installed between the collective braided shield 5 and the shield layer 22. This improvement can realize the composite cable 1 whose high frequency characteristics are not easily deteriorated even if the cable is wired bent or twisted. Also, using a two-core parallel cable as the signal transmission cable 2 controls a length difference between the signal lines 21 and controls the deterioration of the high frequency characteristics due to skew.

Also, by configuring the pair of power supply lines 3 contacting to each other and the pair of power supply lines 3 contacting to the signal transmission cable 2 respectively, for example, compared with a case where the signal transmission cable 2 is placed between the pair of power supply lines 3, the composite cable 1 with a smaller diameter can be produced so that the composite cable 1 can be easily wired even in a narrow space. Moreover, by closely contacting the collective braided shield 5 and the shield layer 22, the diameter of the composite cable 1 can be further downsized.

SUMMARY OF THE EMBODIMENT

Technical ideas understood from the embodiment will be described below citing the reference numerals, etc., used for the embodiment. However, each reference numeral described below is not intended to limit the constituent elements in the claims to the members, etc., specifically described in the embodiment.

[1] A composite cable (1) comprising: a signal transmission cable (2) including a pair of signal lines (21) being arranged parallel to each other in a cable longitudinal direction and contacting to each other and a shield layer (22) covering the pair of signal lines (21) together; a pair of power supply lines (3) being arranged contacting to each other and contacting to the shield layer (22); a collective braided shield (5) covering around a cable core (4) comprising the signal transmission cable (2) and the pair of power supply lines (3) collectively; and a sheath (6) covering around the collective braided shield (5), wherein the collective braided shield (5) is configured closely contacting to the shield layer (22) in accordance with an outer shape of the shield layer (22).

[2] The composite cable according to [1], wherein the cable core (4) is configured in such a manner that virtual lines (V) connecting centers of the pair of signal lines (21)

and centers of the pair of power supply lines (3) make a trapezoid shape in the cross-sectional view perpendicular to the cable longitudinal direction.

[3] The composite cable according to [1] or [2], wherein the shield layer (22) includes as one piece a pair of flat areas (22*a*) extending straight along an arrangement direction of the pair of signal lines (21) and a pair of round areas (22*b*) connecting ends of the pair of flat areas (22*a*), wherein the pair of power supply lines (3) are arranged contacting to one of the flat areas (22*a*), wherein the collective braided shield (5) is closely contacting to an entire part of the flat area (22*a*) at a side where the pair of power supply lines (3) are not contacting to and to a part of the pair of round areas (22*b*) at both sides of the flat areas (22*a*).

[4] The composite cable 1 according to any one of [1] to [3], wherein each of the pair of signal lines (21) comprises a signal conductor (211) and an insulator (212) covering around the signal conductor (211), wherein the insulator (212) comprises an inner insulator (212*a*) covering around the signal conductor (211), and an outer insulator (212*b*) covering around the inner insulator (212*a*), wherein the outer insulator (212*b*) has a lower melting point than a melting point of the inner insulator (212*a*).

[5] The composite cable 1 according to [4], wherein the inner insulator (212*a*) has a lower permittivity than a permittivity of the outer insulator (212*b*).

[6] The composite cable 1 according to any one of [1] to [5], wherein the signal transmission cable (2) further comprises a resin tape (23) spirally wrapping around the pair of signal lines (21), wherein the shield layer (22) comprises a metal tape on which a metal layer (222) is provided on one side of a resin layer (221) and an adhesive layer (223) is provided on an other side of the resin layer (221), and configured by spirally wrapping the metal tape around the resin tape (23) in such a manner that the adhesive layer (223) is provided at a side of the resin tape (23).

Although the embodiment of the invention has been described, the invention according to claims is not to be limited to the embodiment described above. Further, please note that not all combinations of the features described in the embodiment are necessary to solve the problem of the invention.

The invention can be appropriately modified and implemented without departing from the gist thereof. For example, in the above embodiment, a case where the insulator 212 of the signal lines 21 is composed of two layers is explained, but the insulator 212 of the signal lines 21 can be composed of three or more layers.

The invention claimed is:

1. A composite cable comprising:

a signal transmission cable including a pair of signal lines being arranged parallel to each other in a cable longitudinal direction and contacting to each other and a shield layer covering the pair of signal lines together;

a pair of power supply lines being arranged contacting to each other and contacting to the shield layer;

a collective braided shield covering around a cable core comprising the signal transmission cable and the pair of power supply lines collectively; and a sheath covering around the collective braided shield, wherein the collective braided shield is configured closely contacting to the shield layer in accordance with an outer shape of the shield layer.

2. The composite cable according to claim 1, wherein the cable core is configured in such a manner that virtual hues connecting centers of the pair of signal lines and centers of the pair of power supply lines make a trapezoid shape in the cross-sectional view perpendicular to the cable longitudinal direction.

3. The composite cable according to claim 1, wherein the shield layer includes as one piece a pair of flat areas extending straight along an arrangement direction of the pair of signal lines and a pair of round areas connecting ends of the pair of flat areas, wherein the pair of power supply lines are arranged contacting to one of the flat areas, and wherein the collective braided shield is closely contacting to an entire part of the flat area at a side where the pair of power supply lines are not contacting to and to a part of the pair of round areas at both sides of the flat areas.

4. The composite cable according to claim 1, wherein each of the pair of signal lines comprises a signal conductor and an insulator covering around the signal conductor, wherein the insulator comprises an inner insulator covering around the signal conductor, and an outer insulator covering around the inner insulator, and wherein the outer insulator has a lower melting point than a melting point of the inner insulator.

5. The composite cable according to claim 4, wherein the inner insulator has a lower permittivity than a permittivity of the outer insulator.

6. The composite cable according to claim 1, wherein the signal transmission cable further comprises a resin tape spirally wrapping around the pair of signal lines, and wherein the shield layer comprises a metal tape on which a metal layer is provided on one side of a resin layer and an adhesive layer is provided on an other side of the resin layer, and configured by spirally wrapping the metal tape around the resin tape in such a manner that the adhesive layer is provided at a side of the resin tape.

* * * * *